United States Patent [19]

Scott et al.

[11] Patent Number: 4,495,997

[45] Date of Patent: Jan. 29, 1985

[54] WELL COMPLETION SYSTEM AND PROCESS

[75] Inventors: James B. Scott; Fred J. Radd, both of Ponca City, Okla.

[73] Assignee: Conoco Inc., Ponca City, Okla.

[21] Appl. No.: 493,559

[22] Filed: May 11, 1983

[51] Int. Cl.[3] ..... E21B 33/14

[52] U.S. Cl. ..... 166/285; 166/242

[58] Field of Search ..... 166/285, 286, 242

[56] References Cited

U.S. PATENT DOCUMENTS

| | | | |
|---|---|---|---|
| 3,205,945 | 9/1965 | Holt et al. | 166/23 |
| 3,255,819 | 6/1966 | Scott et al. | 166/21 |
| 3,467,193 | 9/1969 | Messenger | 166/292 |
| 3,982,590 | 9/1976 | Harriman | 166/285 |

OTHER PUBLICATIONS

"Sand-Coated Casing Aids Cement Jobs", The Oil and Gas Journal, Aug. 19, 1963.

"Rod Welded to Casing Helps Cementing", by Holt et al.; World Oil, Jul. 1964.

*Primary Examiner*—Stephen J. Novosad
*Assistant Examiner*—William P. Neuder
*Attorney, Agent, or Firm*—A. Joe Reinert

[57] ABSTRACT

Well completion system providing for an enhanced bond between a well casing and the surrounding cement sheath. The system comprises a casing string disposed within a well extending to a subterranean location within the earth's crust. A metal ribbon is disposed about the outer surface of the casing to provide a wrapping having a series of helical turns along the length of the casing. A cement sheath in the annulus about the casing encompasses the wrapping and enters into openings therein to provide a bond between the cement and the outer surface of the casing. The metal ribbon may take the form of an expanded metal ribbon having a staggered mesh structure so that a portion of the ribbon stands off from the surface of the casing.

13 Claims, 5 Drawing Figures

FIG. 1
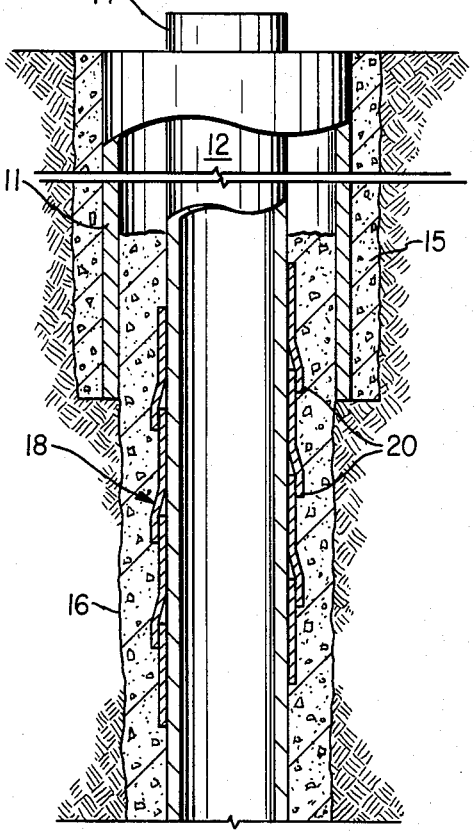
FIG. 2
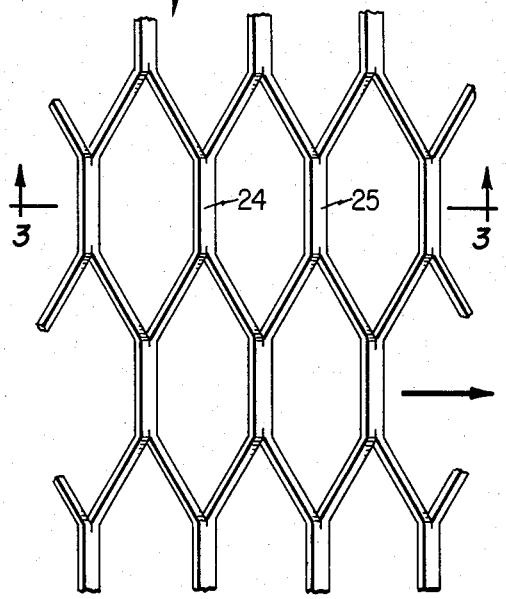
FIG. 3
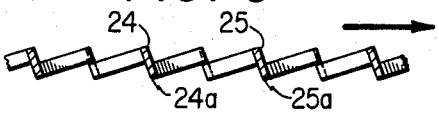
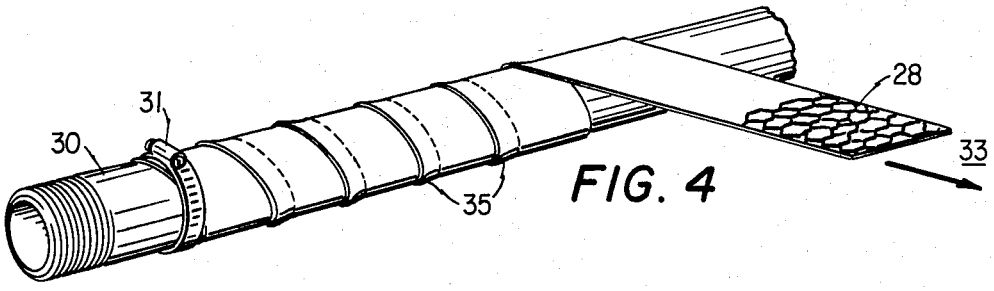
FIG. 4
FIG. 5
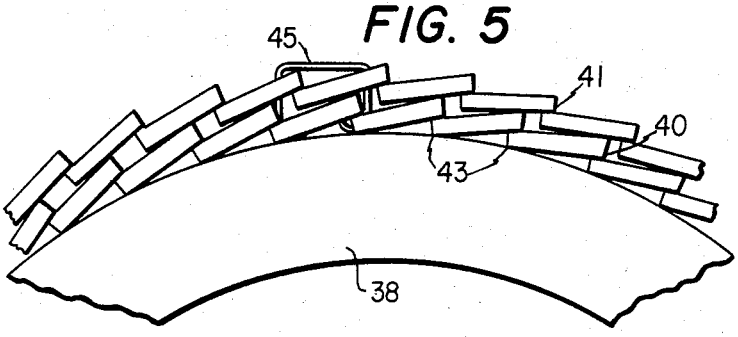

WELL COMPLETION SYSTEM AND PROCESS

DESCRIPTION

1. Technical Field

This invention relates to the completion of wells and more particularly to well completion systems and processes providing for improved bonding between a casing string and a surrounding cement sheath.

2. Background of the Invention

There are various applications in which wells are extended to subterranean locations in the earth's crust. For example, wells are drilled into subterranean formations in order to provide for the production of fluids, such as water, gas or oil, or for the injection of fluids, such as in salt water disposal and in gas or water injection techniques employed in the secondary and tertiary recovery of oil. In order to support the wall of the well and to exclude undesirable fluids from the well, the well is cased with one or more strings of pipe. Typically, the well will be provided with at least a surface or conductor casing and a production string extending to the desired subterranean formation. Particularly in relatively deep wells, one or more intermediate strings of casing may also be employed.

In order to provide for the desired exclusion of fluids, one or more casing strings within the well are cemented in place. The typical well cementing procedure involves pumping a hydraulic cement slurry through the casing to the bottom thereof and then upwardly through the annulus between the outer surface of the casing and the surrounding wall structure, i.e., the wall of the well or the inner wall of an outer casing string. After the cement slurry is in place, it is allowed to set, forming an impermeable sheath which, assuming that good bonds are achieved, prevents the migration of fluids through the annulus surrounding the casing.

There are a number of commonly encountered problems in well completion operations. These include the lack of homogeneous distribution of cement within the casing annulus, thus resulting in vugs or channels within the cement sheath, and poor or incomplete bonding between the cement and the adjacent interfaces. Bonding problems may be encountered at the interface between the cement and the outer surface of the casing and the interface between the cement and the surrounding wall structure. This latter problem is particularly serious where the interface is provided by the wall of the well, i.e., the face of the formation exposed in the well.

A number of procedures have been proposed in order to alleviate one or more of these difficulties. Thus, U.S. Pat. No. 3,205,945 to Holt et al discloses a well completion process in which a hot rolled steel rod in the form of a pre-formed spiral is welded to the outside of the casing at each 180° of the spiral. In this well completion process, the casing is first reciprocated with a 10-foot stroke prior to beginning the cementing operation. During the course of flowing the cement slurry into place, the casing string (and its attached spiral rod) is rotated until the cement stiffens. This procedure is said to cause a tamping and troweling action, a kneading of the cement which eliminates entrained air leading to channels, and a strong bond between the cement sheath and the casing. Furthermore, the pressures otherwise needed for high turbulent flow to provide a good mixing of the cement are avoided.

Poor bonding between the cement sheath and the wall of the well often results from the presence of the filter cake lining the wall following the drilling operation. Various procedures have been employed to remove the filter cake prior to the cementing procedure. For example, it is a conventional practice to remove or at least disrupt the filter cake by means of scratcher elements secured to the external surface of the casing. These abrade the wall of the well as the casing is lowered into place. Another technique involves achieving turbulent flow conditions within the casing annulus as the cement slurry is pumped into place. For example, U.S. Pat. No. 3,467,193 to Messenger discloses a well completion procedure employing successive cement slurries containing a turbulence inducer in order to provide for turbulent flow through the annular space between the casing and the wall of the well. The cement slugs may be preceded by a preflush, also in turbulent flow.

In order to improve the bond between the outer surface of the casing and the surrounding cement sheath, a commonly used procedure is to form a scabrous surface on the exterior of the casing string prior to the cement operation. Thus, U.S. Pat. No. 3,255,819 to Scott et al discloses that a scabrous surface can be formed on the exterior casing surface by reducing the exterior surface of the casing or by adding particulate material to this surface. Thus, the conduit may be subjected to knurling, abrading, etching or quilting procedures; or a particulate solid such as sand, rock, gravel, shell, frit, metal, metal shavings and the like can be applied to the exterior casing surface by means of a suitable adhesive material. Particularly disclosed in Scott et al is the use of sand in an adhesive matrix formed of an epoxy resin.

DISCLOSURE OF THE INVENTION

In accordance with the present invention, there is provided a new and improved well-completion process and structure providing for an enhanced hydraulic bond between a well casing and a surrounding cement sheath. The structure of the present invention comprises a string of casing disposed within a well extending to a subterranean location within the earth's crust. A wrapping of a metal ribbon is disposed about the outer surface of the casing in a conformation providing a series of helical turns along the length of the casing. The well is provided with a cement sheath in the annulus about the casing. The cement sheath encompasses the metal ribbon wrapping and enters into openings there to provide a bond between the cement and the casing surface. In a preferred embodiment of the invention, the metal ribbon has inwardly projecting portions on the inside thereof which contacts the outer surface of the casing and provides a standoff relationship between the casing surface and other portions of the metal ribbon. Preferably the inwardly projecting portions have cutting edges which form acute angles with the outer surface of the casing.

In a further aspect of the invention, there is provided a well-completion process in which a final or intermediate casing string is cemented to the wall of the well. In carrying out this aspect of the invention, there is provided a plurality of casing joints with a wrapping of perforated metal ribbon disposed about the outer surface of the joints in a helically wound conformation. The joints are installed in the well to form a casing string therein and provide an annular space between the casing string and the wall of the well. Thereafter, a slurry of hydraulic cement is flowed into the annular space and allowed to set, thus forming a cement sheath between the casing string and the wall of the well. Preferably the ribbon is wound about the casing in a manner so that adjacent helical turns partially overlap one another. In addition to increasing the integrity of the metal wrapping, the overlap region, together with the irregular surface provided by the perforated structure, tends to promote turbulent flow conditions. In this aspect of the invention, the cement slurry preferably contains a turbulence inducer.

BRIEF DESCRIPTION OF THE DRAWINGS

FIG. 1 is a schematic illustration, partially in section, showing a well completed in accordance with the present invention;

FIG. 2 is a perspective view of a preferred form of metal rib on employed in the present invention;

FIG. 3 is a sectional view of the metal strapping taken along its longitudinal axis as indicated by line 3—3 in FIG. 2;

FIG. 4 is a perspective view of a casing joint provided with a helical wrapping of perforated metal ribbon in accordance with the present invention; and FIG. 5 is a transverse view of a portion of the wall of a casing and the surrounding wrapping showing one helical turn overlying another.

BEST MODES FOR CARRYING OUT THE INVENTION

While the present invention may be employed in the completion of any type of well having a cemented casing string, it is particularly applicable to wells which are to be subjected to high temperature conditions. Such conditions are found in thermal oil recovery applications in which a heated fluid, e.g., steam or hot water is introduced through an injection well into a subterranean oil-bearing formation. Other circumstances involve the production of hot fluids from a subterranean formation such as in the recovery of oil by in situ combustion or in geothermal recovery techniques where high temperature steam is recovered. In such applications, the well is subjected to downhole temperatures ranging from about 300° F. to 600° F., or even higher, and the resultant thermal expansion of the casing places the hydraulic bond between the casing and cement sheath under stress. Such thermal stressing is exacerbated in cases where the well encounters alternate cycles of heating and cooling. For example, in the so-called "huff and puff" steam recovery processes, steam is injected down the well for a period of hours or days. Steam injection is then terminated and the well is placed on production to recover the heated oil, which is at a relatively cool temperature in relation to the steam injection temperature.

The cement employed in carrying out the present invention may be of any suitable type. Typically, the cement will take the form of portland type cements or, in the case of high temperature applications, alumina-type cements such as pozzolan cement, in "neat" slurries, i.e., without the addition of aggregate. However, the hydraulic cement may be employed in slurries containing aggregates such as sand, gravel, perlite and the like.

Turning now to FIG. 1 of the drawing, there is illustrated a well bore 10 which extends to a suitable subterranean location (not shown) in the earth's crust. The well is equipped with a surface or conductor casing 11, normally extending to a depth of several hundred feet, and a primary casing string 12, e.g., a production string in the case of an oil well, extending to the desired subterranean formation. The casing string 12 may be set to the top of the formation with the well drilled further in an "openhole" completion format, or it may extend through the formation and the well completed by a suitable perforation procedure. Such completion techniques are well known to those skilled in the art and will not be described further. Also, it would be recognized that while only two casing strings are shown, both of which are suspended from the wellhead 14, other intermediate strings may be provided and the casing strings may be suspended from the wellhead or from the bottom of larger casing strings.

The casing strings 11 and 12 are surrounded by cement sheaths 15 and 16, respectively. A metal ribbon or strapping 18 is wound about the casing 12 in a spiral conformation to provide a wrapping having successive series of helical turns. The wrapping has openings or perforations (not shown) into which the cement slurry enters during the cementing operation and provides a rigid structure which retains its integrity at the temperatures on the order of 600° F. which may be encountered in high temperature well operations. Preferably, the successive helical turns of the metal wrapping overlap one another, as indicated by reference character 20, to provide an overlap zone in the spiral wrapping. In order to increase the integrity of the wrapping, the successive turns are secured to one another at spaced-apart locations along the overlap zone.

Preferably, the metal strapping has inwardly projecting portions which contact the outer surface of the casing 12 and provide a standoff relationship between the casing outer surface and the remainder of the metal strapping. The inwardly projecting portions have cutting edges which form acute angles with the outer surface of the casing. As explained in greater detail hereinafter, the cutting edges tend to dig into the casing surface and provide indentations therein, thus increasing the hydraulic bond between the cement sheath and the casing.

Turning now to FIGS. 2 and 3, there is illustrated a preferred form of metal ribbon 22 employed in the present invention. As shown in the perspective (plan) view of FIG. 2, the perforated ribbon 22 is in the form of an expanded metal strap. The expanded metal has a honeycomb-like structure providing a staggered mesh configuration, as shown in FIG. 2 and also in the sectional view of FIG. 3. The expanded metal structure is oriented so that the bight portions, such as indicated by reference numerals 24 and 25, extend along the transverse dimension of the ribbon which normally will be about 4–10 inches wide. As shown in FIG. 3, the bight portions of the staggered mesh structure provide cutting edges **24*a* and 25*a* which, when the ribbon is installed, form acute angles with the outer surface of the casing. Thus, when the ribbon is anchored at one end to the casing and wrapped about the casing by pulling in the direction indicated by the arrows shown in FIGS. 2 and 3**, the lower edges of the bight portions of the mesh will tend to dig into the casing surface. It will also be recognized that, when the cement slurry is applied to the wrapped casing, the cement, as it sets, will form an encompassing or interlocking structure with the mesh, thus enhancing the casing cement bond.

In addition to increasing the bond between the outer surface of the casing and the cement, the irregular surface provided by the metal ribbon acts to increase the tendency of the cement slurry to flow in turbulence as it is pumped into the annulus between the casing and the wall of the well. As noted previously, turbulent flow of the slurry during the cementing step acts to disrupt the filter cake on the wall of the wellbore, thus enhancing the bond at the outer surface of the cement sheath. A turbulence inducer may be added to the cement slurry in order to augment the tendency for turbulent flow. Suitable turbulence inducers are water soluble alkyl aryl sulfonates, polyphosphates, lignosulfonates and synthetic polymers and organic acids. Such turbulence inducers are well known to those skilled in the art and, for a further description thereof and their use in well cementing operations, reference is made to the aforementioned patent to Messenger. The overlapping of the metal ribbon, in addition to increasing the structural integrity of the wrapping, also tends to promote turbulent flow of the cement slurry.

The expanded metal ribbon may be formed from any suitable sheet metal stock so long as the final product has sufficient flexibility and strength to be wound around the casing in a conforming relationship. It may have a structure similar to commercially available plaster lath except that it will be in the form of long narrow ribbons rather than in sheets. Also it will be recognized that various other types of perforated metal strapping may be employed in accordance with the broad concept of the present invention. For example, the wrapping may be formed by a sheet metal ribbon which is perforated by a stamping operation, preferably in a manner to provide projecting lips about the perforations.

Prior to the wrapping operations, it usually will be desirable to treat the outer surface of the casing to remove extraneous material which would interfere with the casing-cement bond. For example, the casing may be subjected to a sand blasting operation in order to remove the mill varnish which is normally found on the casing when it is delivered to the field.

Turning now to FIG. 4, there is shown a perspective view of a casing joint undergoing wrapping with an expanded metal ribbon of the type shown in FIGS. 2 and 3. As illustrated in FIG. 4, the metal ribbon 28 is secured to one end of the pipe joint 30 by means of a circumferential clamp 31. Other suitable securing means, such as by welding and the like, may also be employed. After securing one end of the metal ribbon, it is stressed in tension by pulling in the direction indicated by arrow 33 and wrapped about the pipe joint to provide partial overlapping of successive helical turns as indicated by reference character 35. The wrapping operation can be carried out on the rig floor, after several joints of pipe are made up in a stand, or may be carried out externally, e.g., on a pipe rack. In either case it will usually be convenient to rotate the pipe during the wrapping operating while moving the metal ribbon longitudinally along the pipe.

As noted previously, the bight portions of the expanded metal mesh are oriented transversely of the longitudinal axis of the ribbon as indicated by arrow 33. The wrapping normally will be carried out so that the successive helical turns overlap one another by about 1/5–$\frac{1}{3}$ of the width of the ribbon.

FIG. 5 is a transverse view of a portion of the wall 38 of the pipe joint 30 showing the overlapping relationship between successive helical turns of ribbon. The ribbon is shown in exaggerated dimensions relative to the pipe wall. As illustrated, the ribbon is wrapped around the pipe so that the bight portions form a positive front-rake angle with the casing surface. That is, the bight portions 43 in helical turn 40 slope in the direction of the next succeeding overlying turn 41 so that the cutting edges tend to dig into rather than scrape the casing surface. The overlapping turns are secured to one another by means of staples such as indicated by reference number 45 in FIG. 5. At the conclusion of the wrapping operation, the ribbon is secured to the other end of the casing string by any suitable means (not shown) such as a clamp or by welding.

Having described specific embodiments of the present invention, it will be understood that modifications thereof may be suggested to those skilled in the art and it is intended to cover all such modifications as fall within the scope of the appended claims.

What is claimed is:

1. In a well extending to a subterranean location in the earth's crust, the combination comprising:

(a) a string of casing located in said well;

(b) a wrapping of a metal ribbon disposed about the outer surface of said casing in a conformation providing a series of helical turns and having a plurality of openings therein; and (c) a cement sheath in the annulus about said casing and encompassing said wrapping and intering into said openings whereby said cement is bonded to said casing;

wherein said inwardly projecting portions have cutting edges which form acute angles with the outer surface of said casing.

2. In a well extending to a subterranean location in the earth's crust, the combination comprising:

(a) a string of casing located in said well;

(b) a wrapping of a metal ribbon disposed about the outer surface of said casing in a conformation providing a series of helical turns and having a plurality of openings therein; and (c) a cement sheath in the annulus about said casing and encompassing said wrapping and intering into said openings whereby said cement is bonded to said casing;

wherein said metal is disposed about said casing so that adjacent helical turns partially overlap one another to provide an overlap zone and further comprising means securing the overlying turns to the underlying turns of said ribbon at spaced locations along said overlap zone.

3. The combination of claim 2 wherein said securing means comprises staples extending through the overlapping turns of said metal ribbon.

4. In a well extending to a subterranean location in the earth's crust, the combination comprising:

(a) a string of casing located in said well;

(b) a wrapping of a metal ribbon disposed about the outer surface of said casing in a conformation providing a series of helical turns and having a plurality of openings therein; and (c) a cement sheath in the annulus about said casing and encompassing said wrapping and intering into said openings whereby said cement is bonded to said casing;

wherein said metal ribbon is formed of expanded metal to provide a staggered mesh structure whereby a portion of said ribbon stands off from the surface of said casing.

5. The combination of claim 4 wherein the bight portions of said mesh structure extend transversely of the pitch direction of said helical turns.

6. The combination of claim 5 wherein the bight portions of said mesh provide cutting edges which form acute angles with the outer surface of said casing.

7. The combination of claim 6 wherein said ribbon is disposed about said pipe so that adjacent helical turns partially overlap one another.

8. The combination of claim 7 wherein the bight portions of said mesh in each helical turn of said ribbon slope in the direction of the next succeeding overlying turn of said ribbon.

9. In the completion of a well extending to a subterranean location in the earth's crust, the method comprising:

(a) providing a plurality of casing joints with a wrapping of perforated metal ribbon disposed about the outer surface of said joints in a helically wound conformation;

(b) installing said joints in the well to form a casing string therein and provide an annular space between said casing string and the wall of said well;

(c) flowing a slurry of hydraulic cement into said annular space and allowing said cement slurry to set to form a cement sheath between said casing string and the wall of said well;

wherein successive helical turns of said ribbon partially overlap one another.

10. In a method of installing a cement-coated conduit within a well extending to a subterranean location in the earth's crust, the steps comprising:

(a) securing a perforated metal ribbon to said conduit at a first location thereon, said ribbon being formed of expanded metal to provide a staggered mesh structure;

(b) pulling said ribbon under tension and wrapping it about said conduit in a manner providing a series of helical turns about said conduit;

(c) securing said ribbon to said conduit at a second location spaced longitudinally from said first location;

(d) lowering said conduit to a desired location within said well;

(e) flowing a slurry of hydraulic cement into the annulus about said conduit and allowing said cement slurry to set to provide a cement sheath encompassing said metal ribbon whereby said cement is bonded to said conduit.

11. The method of claim 10 wherein said ribbon is pulled in step (b) along a longitudinal axis such that the bight portions of said mesh structure are oriented transversely of said longitudinal axis and provide cutting edges which slope in the forward direction of said axis and contact the outer surface of said conduit at acute angles.

12. The method of claim 11 wherein said ribbon is wrapped around said conduit in a manner such that successive helical turns of said ribbon partially overlap one another to provide an overlap zone.

13. The method of claim 12 further comprising securing successive helical turns of said ribbon to each other at spaced apart locations along said overlap zone.

* * * * *